US012594640B2

(12) United States Patent
Nakayama et al.

(10) Patent No.: US 12,594,640 B2
(45) Date of Patent: Apr. 7, 2026

(54) GRINDING METHOD FOR SLICE WAFER

(71) Applicant: DISCO CORPORATION, Tokyo (JP)

(72) Inventors: Hidekazu Nakayama, Tokyo (JP); Kazutaka Kuwana, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 313 days.

(21) Appl. No.: 18/344,043

(22) Filed: Jun. 29, 2023

(65) Prior Publication Data

US 2024/0009792 A1 Jan. 11, 2024

(30) Foreign Application Priority Data

Jul. 5, 2022 (JP) ..... 2022-108361

(51) Int. Cl.
*B24B 7/22* (2006.01)
*B24B 27/00* (2006.01)
(Continued)

(52) U.S. Cl.
CPC ..... *B24B 7/228* (2013.01); *B24B 27/0076* (2013.01); *B24B 37/005* (2013.01);
(Continued)

(58) Field of Classification Search
CPC ..... B24B 7/228; B24B 7/04; B24B 27/0076; B24B 27/0069; B24B 27/0046; B24B 41/04; B24B 41/06; B24B 41/005; B24B 41/068; B24B 41/061; B24B 37/00; B24B 37/005; B24B 37/013; B24B 37/02;
(Continued)

(56) References Cited

U.S. PATENT DOCUMENTS

2008/0090505 A1* 4/2008 Yoshida ..... B24B 7/228 451/413
2010/0003907 A1* 1/2010 Hirayama ..... B24B 7/228 451/398

(Continued)

FOREIGN PATENT DOCUMENTS

JP 2009090389 A 4/2009
JP 2013119123 A 6/2013

(Continued)

OTHER PUBLICATIONS

Office Action issued in counterpart Japanese patent application No. 2022-108361, dated Jan. 6, 2026.

*Primary Examiner* — Michael A Gump
(74) *Attorney, Agent, or Firm* — Greer Burns & Crain Ltd.

(57) ABSTRACT

A wafer grinding method includes a step of forming a protective member on one side of a wafer, a first grinding step of grinding the other side of the wafer by setting a chuck-table rotating shaft and a grinding-stone rotating shaft at a first tilt correlation that has taken into consideration sinking of the wafer by compression of the protective member during grinding, and a second grinding step of grinding the wafer on its one side to a predetermined thickness by setting the shafts at a second tilt correlation such that a lower surface of the grinding stone, where the grinding stone is to be in contact with the wafer, and the holding surface become parallel, and bringing the grinding stone into contact at its lower surface with a radial segment of the one side of the wafer.

3 Claims, 5 Drawing Sheets

(51) Int. Cl.

| | |
|---|---|
| ***B24B 37/005*** | (2012.01) |
| ***B24B 37/013*** | (2012.01) |
| ***B24B 37/02*** | (2012.01) |
| ***B24B 37/04*** | (2012.01) |
| ***B24B 41/04*** | (2006.01) |
| ***B24B 47/22*** | (2006.01) |

(52) U.S. Cl.
CPC ..... *B24B 37/013* (2013.01); *B24B 37/02* (2013.01); *B24B 37/04* (2013.01); *B24B 41/04* (2013.01); *B24B 47/22* (2013.01)

(58) Field of Classification Search
CPC ..... B24B 37/04; B24B 37/042; B24B 37/07; B24B 37/10; B24B 37/105; B24B 37/107; B24B 37/30; B24B 37/34; B24B 37/12; B24B 9/065; B24B 47/22; B24B 49/02; B24B 49/04; H01L 21/02013; H01L 21/67132; H01L 21/304; H01L 21/68764
USPC .... 451/41, 5, 9, 11, 282, 285, 289, 387, 405
See application file for complete search history.

(56) References Cited

U.S. PATENT DOCUMENTS

| | | | | |
|---|---|---|---|---|
| 2019/0152019 | A1* | 5/2019 | Hirata | C30B 29/36 |
| 2020/0316750 | A1* | 10/2020 | Matsubara | B24B 49/02 |

FOREIGN PATENT DOCUMENTS

| | | | | |
|---|---|---|---|---|
| JP | 2016167546 A | * | 9/2016 | H01L 21/56 |
| JP | 2022029511 A | | 2/2022 | |

* cited by examiner

GRINDING METHOD FOR SLICE WAFER

BACKGROUND OF THE INVENTION

Field of the Invention

The present invention relates to a method for grinding both sides of a slice wafer sliced from an ingot.

Description of the Related Art

A grinding machine for grinding a wafer is configured to grind the wafer by bringing a rotating annular grinding stones into contact with the wafer while rotating a chuck table, on a holding surface on which the wafer is held, together with the wafer. However, the holding surface of the chuck table is formed as a conical surface. The wafer is therefore ground to have a uniform thickness within the wafer by adjusting the parallelism between the holding surface of the chuck table and a lower surface of the annular grinding stones (see, for example, JP 2013-119123A).

In general, a wafer, specifically a "slice wafer" sliced from an ingot includes warpage or waviness. As proposed in JP 2016-167546A, the warpage or waviness of the wafer is hence removed by forming a protective member over the entirety of one side of the wafer, and grinding the other side, on which the protective member is not formed, of the wafer, with the one side of the wafer held on the holding surface of the chuck table via the protective member. The protective member is then removed, and with the other side of the wafer held on the holding surface of the chuck table, the one side, from which the protective member has been removed, of the wafer is then ground to provide the wafer with a predetermined thickness. In other words, when grinding the other side of the wafer, the wafer is held via the protective member on the holding surface of the chuck table, and when grinding the one side of the wafer, from which the protective member has been removed, the other side of the wafer is held directly on the holding surface of the chuck table.

Here, the protective member has been formed by spreading a liquid resin over the one side of the wafer, and curing the liquid resin.

SUMMARY OF THE INVENTION

If a protective member is formed on the one side of a wafer using a liquid resin, and grinding is then performed by pressing annular grinding stones at a lower surface thereof against a radial segment of the other side, on which the protective member is not formed, of the wafer, with the wafer held on the holding surface of the chuck table via the resin-made protective member, the resin-made protective member is compressed and elastically deformed by a vertical load from the annular grinding stones, thereby raising a problem that the wafer is tilted with respect to the holding surface and the wafer ground on both sides thereof hence does not have a thickness uniform over the entire sides.

The present invention therefore has as an object thereof the provision of a method that can grind both sides of a slice wafer such that it has a uniform thickness over the entire surface.

In accordance with an aspect of the present invention there is provided a method for grinding a slice wafer on both sides thereof by annular grinding stones. The method includes a protective member forming step of forming a protective member by spreading a liquid resin over the entirety of one side of the slice wafer, and curing the liquid resin, a first grinding step of grinding the entirety of the other side of the slice wafer by holding the slice wafer on a conical holding surface of a chuck table via the protective member, setting a chuck-table rotating shaft, which passes through a center of the holding surface, and a grinding-stone rotating shaft, which passes through a center of the annular grinding stones, at a first tilt correlation that has taken into consideration sinking of the slice wafer by compression of the protective member through contact of the annular grinding stones with the slice wafer during grinding, rotating the chuck table with the slice wafer held thereon and the annular grinding stones in the same direction at different speeds, and bringing the rotating annular grinding stones into contact at a lower surface thereof with a radial segment of the other side of the rotating slice wafer, a protective member peeling step of, after the first grinding step, peeling off the protective member, and a second grinding step of, after the protective member peeling step, grinding the slice wafer on the entirety of the one side thereof to a predetermined thickness by holding the other side of the slice wafer on the holding surface of the chuck table, setting the chuck-table rotating shaft and the grinding-stone rotating shaft at a second tilt correlation such that a lower surface of the annular grinding stones, at which the annular grinding stones are to be in contact with the slice wafer during grinding, and the holding surface of the chuck table become parallel to each other, rotating the chuck table with the slice wafer held thereon and the annular grinding stones in the same direction at different speeds, and bringing the rotating annular grinding stones into contact at the lower surface thereof with a radial segment of the one side of the rotating slice wafer.

According to the present invention, there can be provided such an advantageous effect that a wafer can be ground to a uniform thickness over the entire surface thereof without being affected by sinking of the wafer associated with compression deformation of a protective member.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

With reference to the attached drawings, a description will hereinafter be made about a grinding method according to an embodiment of the present invention for a slice wafer. Configurations of a grinding machine 1 for performing the grinding method of this embodiment will first be described on the basis of FIG. 1. It is to be noted that in the following description, directions of arrows illustrated in FIG. 1 should indicate an X-axis direction (left-right direction), a Y-axis direction (front-rear direction), and a Z-axis direction (up-down direction), respectively.

Figure 1:
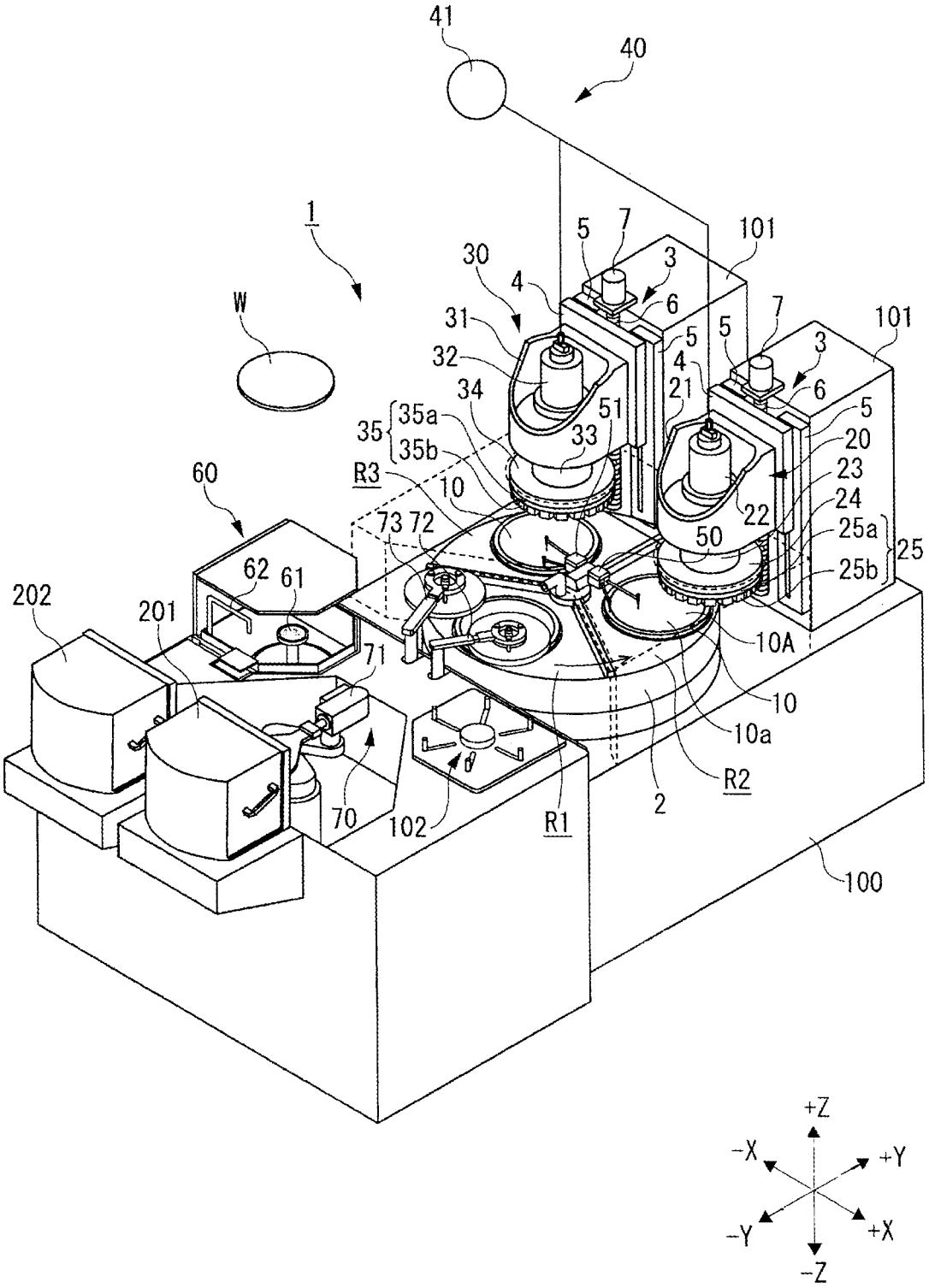
FIG. 1 is a partly cut-away perspective view illustrating a grinding machine for performing a grinding method according to an embodiment of the present invention for a slice wafer.

The grinding machine 1 illustrated in FIG. 1 is useful in performing grinding processing of a disk-shaped slice wafer (which may hereinafter be simply called the "wafer") W obtained by slicing an ingot, and includes, as principal elements, three chuck tables 10 arranged on a rotatable, disk-shaped turn table 2, a coarse-grinding unit 20 and a finish-grinding unit 30 as processing means each for grinding the wafer W held on each chuck table 10, grinding water supply means 40 for supplying grinding water as a processing fluid to respective annular grinding stones 25*b* and 35*b* of the coarse-grinding unit 20 and the finish-grinding units 30, wafer thickness gauges 50 and 51 that each measure the thickness of the wafer W under grinding processing, a rinsing unit 60 that rinses an upper surface (ground surface) of the wafer W after finish grinding, and a transfer unit 70 that transfers the wafer W.

Typically, the wafer W before grinding processing is a slice wafer obtained by slicing a cylindrical ingot, which is made of single-crystal silicon, with a wire saw, and this slice wafer W involves warpage or waviness.

A description will next be made about the respective configurations of the principal elements of the grinding machine 1, that is, the chuck tables 10, the coarse-grinding unit 20, the finish-grinding unit 30, the grinding water supply means 40, the wafer thickness gauges 50 and 51, the rinsing unit 60, and the transfer unit 70.

The three chuck tables 10 are disk-shaped members, and are arranged at an equal angular pitch (1200 pitch) in a peripheral direction on the turn table 2 that intermittently rotates about an axis of rotation perpendicular to the Z-axis direction. Responsively to intermittent rotation of the turn table 2, these chuck tables 10 each revolve by 120-degree angles about an axis of rotation of the turn table 2, which is perpendicular to the Z-axis direction, to sequentially move in the order of a wafer loading/unloading region R1, a coarse-grinding region R2, and a finish-grinding region R3, and at the same time each rotate at a predetermined speed about an axial centerline CL1 (see FIGS. 4 to 7) of a chuck-table rotating shaft 13 by a rotary drive mechanism (not illustrated).

Further, each chuck table 10 includes a disk-shaped porous member 10A that include porous ceramics or the like and are assembled in a central portion thereof, and the porous member 10A forms on an upper surface thereof a holding surface 10*a* that holds the disk-shaped wafer W under suction.

The coarse-grinding unit 20 and the finish-grinding unit 30 are arranged side by side along the X-axis direction (left-right direction) at an end portion (rear end portion) in a +Y-axis direction of a rectangular box-shaped bed 100 that is long in the Y-axis direction (front-rear direction), and are disposed upright along the Z-axis direction (up-down direction). Here, the coarse-grinding unit 20 is used to perform coarse grinding of the upper surface (to-be-ground surface) of the wafer W held on the holding surface 10*a* of the chuck table 10 located in the coarse-grinding region R2, and the finish-grinding unit 30 is used to perform finish grinding of the upper surface (to-be-ground surface) of the wafer W held on the holding surface 10*a* of the chuck table 10 located in the finish-grinding region R3. The coarse-grinding unit 20 and the finish-grinding unit 30 have the same basic configuration.

Specifically, the coarse-grinding unit 20 includes a spindle motor 22 fixed on a holder 21, a vertical spindle 23 drivable for rotation by the spindle motor 22, a disk-shaped mount 24 attached to a lower end of the spindle 23, and a grinding wheel 25 detachably mounted on a lower surface of the mount 24. Here, the grinding wheel 25 includes a disk-shaped base 25*a* and annular grinding stones (coarse-grinding, annular grinding stones) 25*b* formed from a plurality of grinding stone segments secured as processing members in an annular pattern on a lower surface of the base 25*a*, and is rotationally driven about an axial centerline CL2 (see FIGS. 4 and 6) of the spindle 23 as a grinding-stone rotating shaft.

Similarly to the coarse-grinding unit 20, the finish-grinding unit 30 also includes a spindle motor 32 fixed on a holder 31, a vertical spindle 33 drivable for rotation by the spindle motor 32, a disk-shaped mount 34 attached to a lower end of the spindle 33, and a grinding wheel 35 detachably mounted on a lower surface of the mount 34. Here, the grinding wheel 35 includes a disk-shaped base 35*a*, and annular grinding stones (finish-grinding, annular grinding stones) 35*b* formed from a plurality of grinding stone segments secured as processing members in an annular pattern on a lower surface of the base 35*a*. The grinding stone segments of the annular grinding stones (finish-grinding, annular grinding stones) 35*b* are formed with finer abrasive grits than the grinding stone segments of the annular grinding stones (coarse-grinding, annular grinding stones) 25*b* of the coarse-grinding unit 20.

The coarse-grinding unit 20 and the finish-grinding unit 30 are supported movably up and down on lift mechanisms 3, respectively, which are disposed on respective end surfaces (front surfaces) in a −Y-axis direction of a pair of block-shaped columns 101 disposed upright and side by side along the X-axis direction (left-right direction) on the end portion (rear end portion) in the +Y-axis direction of the bed 100. As both of the lift mechanisms 3 are the same in configuration, they will hereinafter be described by identifying corresponding elements with the same reference characters.

Each lift mechanism 3 moves the coarse-grinding unit 20 or the finish-grinding unit 30 up or down along the Z-axis direction (up-down direction), and includes a rectangular lift plate 4, and a pair of left and right guide rails 5 for guiding the upward or downward movement of the lift plate 4. To the lift plate 4, the coarse-grinding unit 20 or the finish-grinding unit 30 is attached. The paired left and right guide rails 5 are arranged vertically and parallel to each other on the front surface of the column 201.

Further, between the paired left and right guide rails 5, a rotatable ball screw 6 is vertically disposed upright along the Z-axis direction (up-down direction). The ball screw 6 is connected at an upper end thereof to a reversible electric motor 7 as a drive source. At a lower end of the ball screw 6, on the other hand, the ball screw 6 is rotatably supported on the column 101 via a bearing (not illustrated). In threaded engagement with this ball screw 6, a nut member (not illustrated) is arranged. This nut member is disposed on a rear surface of the lift plate 4, and protrudes horizontally rearward (in the +Y-axis direction).

When the electric motor 7 of each lift mechanism 3 configured as described above is actuated to rotate the ball screw 6 in the normal direction or in the reverse direction, the lift plate 4 with the nut member (not illustrated), which is in threaded engagement with the ball screw 6 and is disposed protruding therefrom, is moved up or down. The coarse-grinding unit 20 or the finish-grinding unit 30 attached to the lift plate 4 is therefore moved up or down along the Z-axis direction (up-down direction) independently of the finish-grinding unit 30 or the coarse-grinding unit 20.

The grinding water supply means 40 is to supply the grinding water as a processing fluid to both the annular grinding stones 25*b* of the coarse-grinding unit 20 and the annular grinding stones 35*b* of the finish-grinding unit 30. This grinding water supply means 40 supplies the grinding water from a grinding water supply source 41 to the annular grinding stones 25*b* and 35*b* of the individual grinding wheels 25 and 35 through the individual spindle motors 22 and 32 and axial centers of the individual spindles 23 and 33 of the coarse-grinding unit 20 and the finish-grinding unit 30. The individual annular grinding stones 25*b* and 35*b* are hence cooled and lubricated with the grinding water at their surfaces of contact with the wafer W. As the grinding water, pure water is suitably used.

The one wafer thickness gauge 50 measures the thickness of the wafer W under coarse grinding, whereas the other wafer thickness gauge 51 measures the thickness of the wafer W under finish grinding. Specifically, the one wafer thickness gauge 50 measures the thickness of the wafer W under coarse grinding by subtracting the height of the upper surface of the holding surface 10*a* of the chuck table 10 from the height of the upper surface of the wafer W, whereas the other wafer thickness gauge 51 measures the thickness of the wafer W under finish grinding by subtracting the height of the upper surface of the holding surface 10*a* of the chuck table 10 from the height of the upper surface of the wafer W.

The rinsing unit 60 serves to rinse the wafer W that has been subjected to finish grinding by the finish-grinding unit 30, and hence to remove grinding debris and the like stuck on the ground surface (upper surface) of the wafer W, and is configured including a spinner table 61 that rotates with the wafer W held thereon after the finish grinding, and a rinse water nozzle 62 that ejects rinse water (pure water) toward the ground surface of the wafer W.

In the grinding machine 1 for use in the grinding method according to this embodiment, cassettes 201 and 202 are arranged on a side of a front end (an end portion in the −Y-axis direction) of the bed 100 as illustrated in FIG. 1. The cassette 201 stores a plurality of wafers W before grinding processing, and the cassette 202 stores the plurality of wafers W after the grinding processing. The transfer unit 70 includes loading/unloading means 71, first transfer means 72, and second transfer means 73. The loading/unloading means 71 loads or unloads each wafer W into or from the cassette 201, and transfers each wafer W which has been taken out of the cassette 201, onto an alignment table 102. The first transfer means 72 transfers each wafer W which has been aligned on the alignment table 102, onto the chuck table 10 located in the wafer loading/unloading region R1. The second transfer means 73 takes each wafer W which has been subjected to finish grinding by the finish-grinding unit 30, out of the chuck table 10 located in the finish-grinding region R3, and transfers it to the rinsing unit 60.

Figure 2:
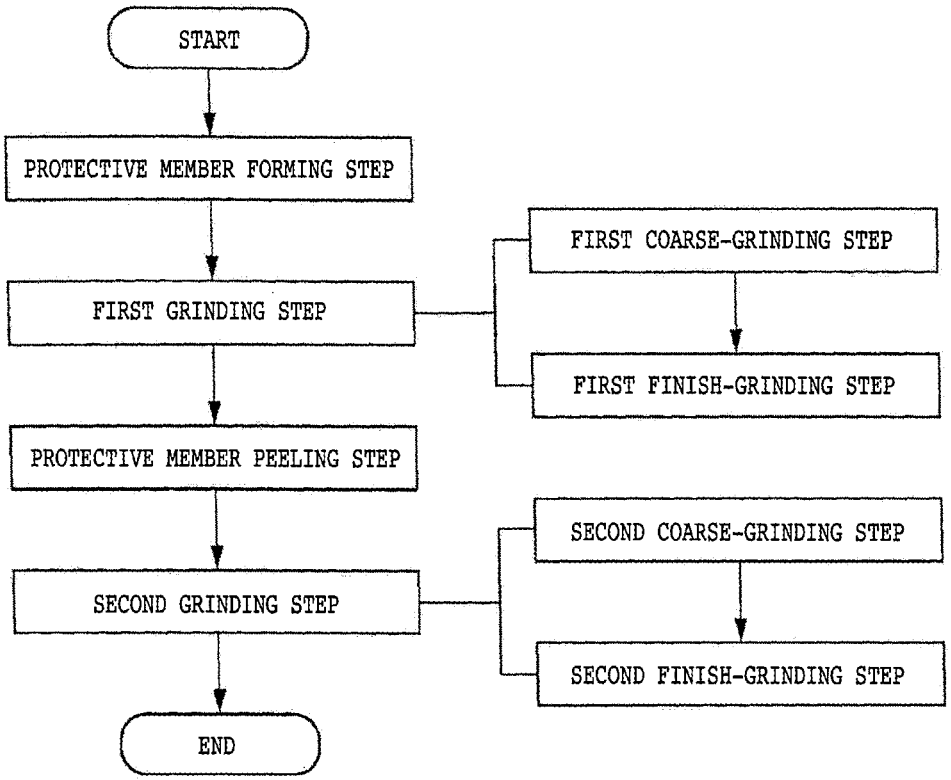
FIG. 2 is a flow chart illustrating steps of the grinding method.

A description will next be made about the grinding method according to this embodiment for the wafer W by the grinding machine 1 configured as described above. As illustrated in FIG. 2, the grinding method according to this embodiment grinds the wafer W to a predetermined thickness by sequentially going through 1) a protective member forming step, 2) a first grinding step (a first coarse-grinding step and a first finish-grinding step), 3) a protective member peeling step, and 4) a second grinding step (a second coarse-grinding step and a second finish-grinding step). The individual steps will hereinafter be described one by one.

1) Protective Member Forming Step:

The protective member forming step is to form a protective member F (see FIG. 3E) on one side of the wafer W, and is performed by sequentially going through steps illustrated in FIGS. 3A to 3E.

Figure 3A:
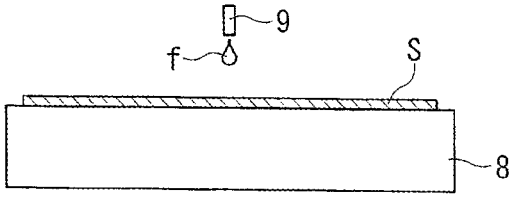
FIG. 3A through 3E are cross-sectional views illustrating a protective member forming step in the grinding method.

Specifically, as illustrated in FIG. 3A, a thin sheet S is placed on an upper surface of a stage 8, and the sheet S is then held under suction on the upper surface of the stage 8 by a suction force of a suction source (not illustrated). No particular limitation is imposed on the material of the sheet S. For example, polyethylene (PE), polyethylene terephthalate (PET), or the like is suitably used.

Figure 3B:
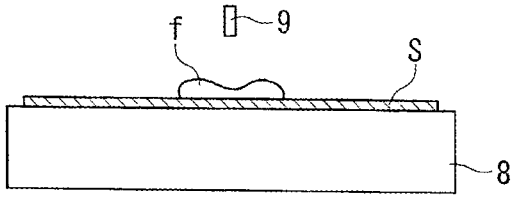

As illustrated in FIG. 3B, a predetermined amount of a liquid resin f is then dropped from a resin supply nozzle 9, which is located above the stage 8, toward a central area of an upper surface of the sheet S. As this liquid resin f, a photocurable resin that is cured by irradiation of ultraviolet light or the like is used.

At a time point when the predetermined amount of the liquid resin f has deposited in a liquid puddle form on the upper surface of the sheet S, the dropping of the liquid resin f from the resin supply nozzle 9 onto the sheet S is stopped. It is to be noted that the amount of the liquid resin f to be dropped onto the sheet S is determined by the thickness of the protective member F (see FIG. 3E) to be formed subsequently by the curing of the liquid resin f and the area of the wafer W.

Figure 3C:
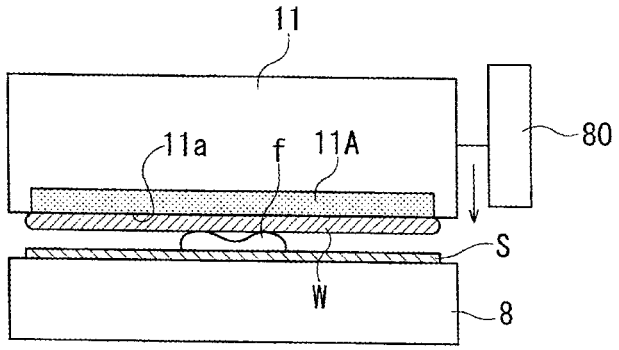

As illustrated in FIG. 3C, the wafer W held under suction on a lower surface of a holding member 11 is positioned above the liquid resin f. A disk-shaped porous member 11A is centrally fitted in a lower portion of the holding member 11, and a holding surface 11*a* on a lower surface of the porous member 11A is drawn by a suction source (not illustrated), whereby the wafer W is held under suction on the holding surface 11*a*. Further, the holding member 11 is movable up and down by a lift mechanism 80 in the Z-axis direction. As described above, the wafer W held on the holding member 11 is a slice wafer obtained by slicing a cylindrical ingot with a wire saw, and involves warpage or waviness.

Figure 3D:
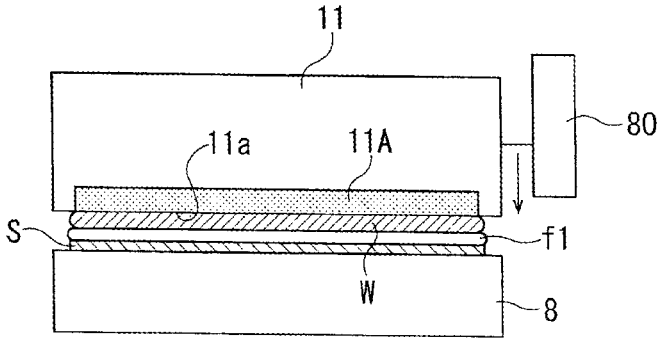

In the above-described stage, the holding member 11 with the wafer W held under suction on the holding surface 11*a* is moved down by the lift mechanism 80 as illustrated in FIG. 3D, so that the liquid resin f on the sheet S is caused to spread in a radial direction by the wafer W until the liquid resin f outwardly protrudes at an outer periphery thereof beyond an outer periphery of the wafer W by a predetermined amount. An uncured resin layer f1 of a uniform thickness is therefore formed over the entirety of the one side (lower surface) of the wafer W.

Figure 3E:
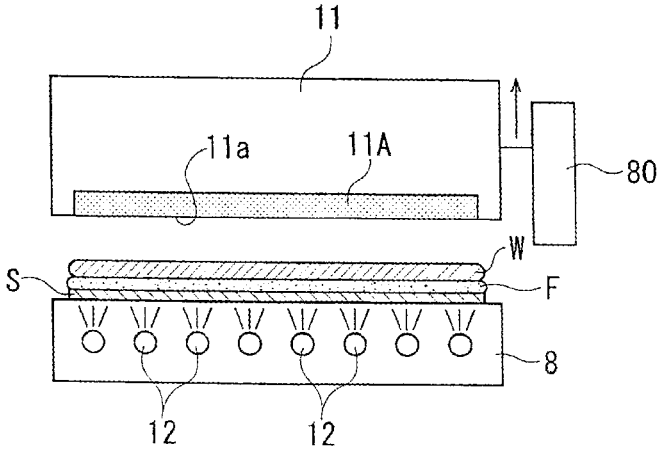

When ultraviolet light is irradiated toward the uncured resin layer f1 of the uniform thickness from a plurality of UV lamps 12 arranged inside the stage 8 as illustrated in FIG. 3E after the uncured resin layer f1 of the uniform thickness has been formed on the one side (lower surface) of the wafer W as mentioned above, the uncured resin layer f1 formed of the photocurable resin is cured to form the protective member F, so that the entirety of the one side of the wafer W is protected by the protective member F.

After the protective member F has been formed over the entirety of the one side of the wafer W as mentioned above, the suction holding of the wafer W by the holding member 11 is released. The holding member 11 is then moved up by the lift mechanism 80, and is hence separated from the wafer W. Now, the series of protective member forming step comes to an end, and the wafer W with the protective member F formed on the one side thereof is stored in the cassette 201 illustrated in FIG. 1.

2) First Grinding Step:

The first grinding step is to grind the other side, on which the protective member F is not formed, of the wafer W on one side of which the protective member F has been formed in the protective member forming step as a preceding step, and includes 2-1) a first coarse-grinding step and 2-2) a first finish-grinding step, both of which will hereinafter be described.

Figure 4:
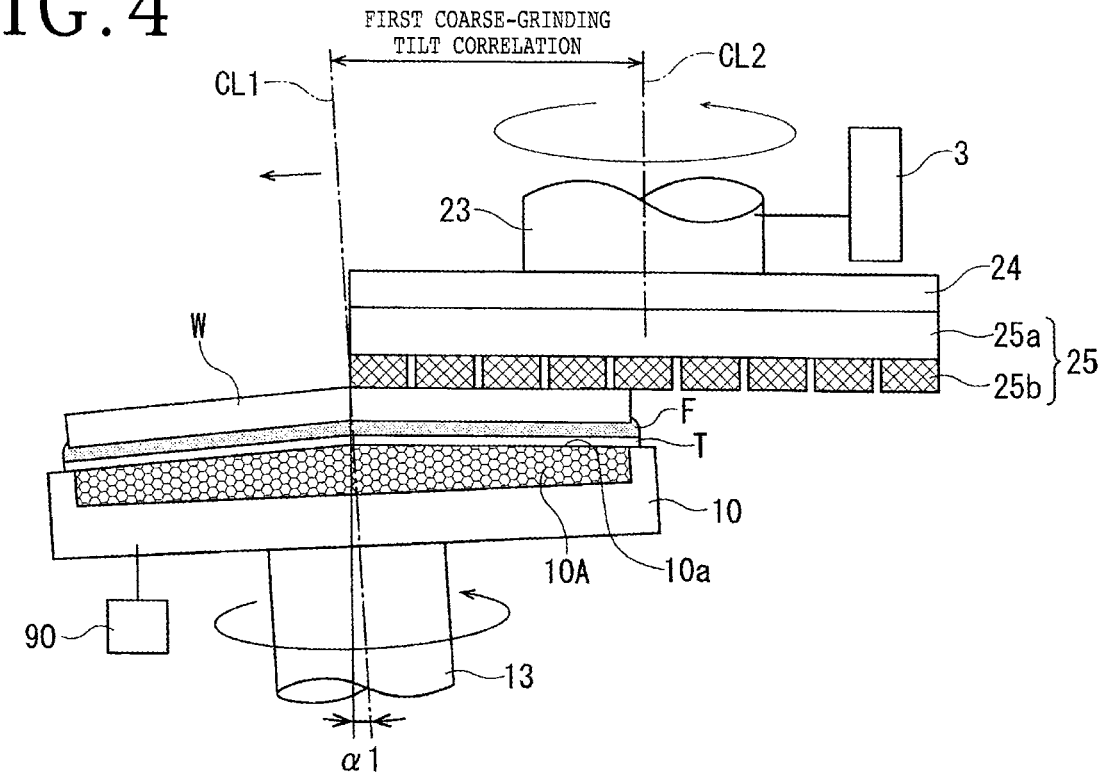
FIG. 4 is a cut-away side view illustrating a first coarse-grinding step in the grinding method.

2-1) First Coarse-Grinding Step:

The first coarse-grinding step is to subject the other side, on which the protective member F is not formed, of the wafer W to coarse grinding by the coarse-grinding unit 20 illustrated in FIG. 1. In this first coarse-grinding step, an unprocessed wafer W is taken out of the cassette 201 by the loading/unloading means 71 illustrated in FIG. 1, and the taken-out wafer W is transferred onto the alignment table 102 with the protective member F directed downward. On the alignment table 102, the wafer W is aligned, the aligned wafer W is transferred by the first transfer means 72 onto the chuck table 10 located in the wafer loading/unloading region R1, and as illustrated in FIG. 4, the wafer W is held under suction on the chuck table 10 with the protective member F directed downward. It is to be noted that a protective tape T is practically bonded to a lower surface of the protective member F.

As illustrated in FIG. 4, the holding surface 10*a* of the chuck table 10 is formed in a conical shape, and the chuck table 10 is provided with a tilt adjustment mechanism 90 for tilting the chuck table 10 by a predetermined angle with respect to a horizontal X-Y plane.

Then, the turn table 2 is rotated by an angle of 120° in a direction of arrow (counterclockwise) about its vertical axis of rotation, so that the chuck table 10 is moved to the coarse-grinding region R2 along with the wafer W held under suction thereon. In this coarse-grinding region R2, the other side (upper surface) of the wafer W held on the holding surface 10*a* of the chuck table 10 is subjected to coarse grinding by the coarse-grinding unit 20.

Specifically, the chuck table 10 is rotationally driven at a predetermined rotational speed (for example, 300 rpm) by the rotary drive mechanism (not illustrated), and at the same time, the spindle motor 22 of the coarse-grinding unit 20 is actuated to rotationally drive the annular grinding stones 25*b* in the same direction as the chuck table 10 at a predetermined speed (for example, 1,000 rpm) different from the chuck table 10.

With the chuck table 10 and the wafer W held thereon and the annular grinding stones 25*b* both kept rotating as mentioned above, the lift mechanism 3 is driven to move the annular grinding stones 25*b* down in the −Z-axis direction. Specifically, when the electric motor 7 is driven and the ball screw 6 is rotated, the lift plate 4 on which the nut member (not illustrated), which is in threaded engagement with the ball screw 6, is disposed is moved down along with the coarse-grinding unit 20 in the −Z-axis direction. The annular grinding stones 25*b* then comes into contact at a lower surface (grinding surface) thereof with a radial segment of the upper surface (other side) of the wafer W. At this time, grinding water is supplied from the grinding water supply source 41 of the grinding water supply means 40 to surfaces of contact between the annular grinding stones 25*b* and the wafer W. While being supplied with the grinding water, the entirety of the other side (upper surface) of the wafer W is therefore subjected to coarse grinding by the rotating annular grinding stones 25*b*, and its thickness is measured by the thickness gauge 50.

In this first coarse-grinding step, the resin-made protective member F is compressed and elastically deformed when the wafer W which is held under suction on the holding surface 10*a* of the chuck table 10 with the protective member F directed downward, receives a vertical load from the annular grinding stones 25*b*. As mentioned above, a problem hence arises that the wafer W is tilted with respect to the holding surface 10*a* of the chuck table 10, and the wafer W hence does not have a uniform thickness over the entire surface thereof even after being ground on both sides thereof through a first finish-grinding step, a second coarse-grinding step, and a second finish-grinding step, all of which will be mentioned later.

In this first coarse-grinding step, as illustrated in FIG. 4, the other side of the wafer W is hence subjected, before the chuck table 10 and the annular grinding stones 25*b* are rotationally driven as described above, to coarse grinding by setting the chuck-table rotating shaft 13, the axial centerline CL1 of which passes through a center of the holding surface 10*a* of the chuck table 10, and the spindle (grinding-stone rotating shaft) 23, the axial centerline CL2 of which passes through a center of the annular grinding stones 25*b*, at a first coarse-grinding tilt correlation that has taken into consideration sinking of the wafer W associated with compression deformation of the protective member F by a vertical load to be received from the annular grinding stones 25*b* during coarse grinding. Specifically, coarse grinding is set to be performed by tilting the axial centerline CL1 of the chuck-table rotating shaft 13 over an angle $\alpha$1 (first predetermined angle) with respect to the vertical axial centerline CL2 of the spindle (grinding-stone rotating shaft) 23 as illustrated in FIG. 4.

It is to be noted that the first coarse-grinding tilt correlation has been determined on the basis of experimental data. In this embodiment, the coarse grinding is set to be performed by tilting the axial centerline CL1 of the chuck-table rotating shaft 13 over the angle $\alpha$1 with respect to the axial centerline CL2 of the spindle (grinding-stone rotating shaft) 23. Conversely, by tilting the axial centerline CL2 of the spindle (grinding-stone rotating shaft) 23 over the angle $\alpha$1 with respect to the vertical axial centerline CL1 of the chuck-table rotating shaft 13, coarse grinding may also be performed. In other words, coarse grinding is performed in this first coarse-grinding step by titling the axial centerline CL1 of the chuck table rotating shaft 13 and the axial centerline CL2 of the spindle (grinding-stone rotating shaft) 23 relative to each other over the angle $\alpha$1.

2-2) First Finish-Grinding Step:

The first finish-grinding step is to perform, by the finish-grinding unit 30, finish grinding of the other side (the surface on the side where the protective member F is not formed) of the wafer W after the other side of the wafer W has been subjected to coarse grinding in the first coarse-grinding step.

Figure 5:
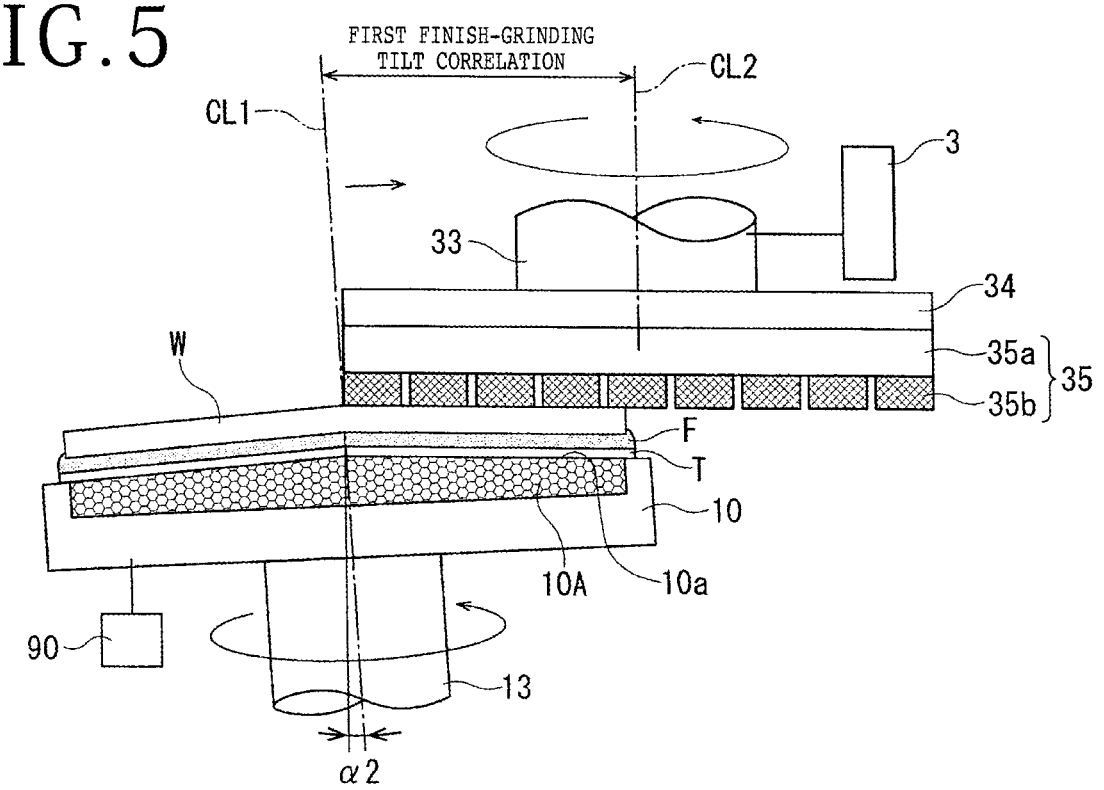
FIG. 5 is a cut-away side view illustrating a first finish-grinding step in the grinding method.

After the other side of the wafer W has been subjected to coarse grinding by the coarse-grinding unit 20 as mentioned above, the coarse-grinding unit 20 is moved up in a +Z-axis direction by the lift mechanism 3, so that the annular grinding stones 25*b* is separated from the other side (upper surface) of the wafer W. Then, the turn table 2 is rotated by an angle of 120° in a direction of arrow (counterclockwise) about its vertical axis of rotation. The wafer W, the other side of which has been subjected to coarse grinding in the coarse-grinding region R2, and the chuck table 10 with the wafer W held thereon are next moved to the finish-grinding region R3. In this finish-grinding region R3, the other side of the wafer W is then subjected to finish grinding by the finish-grinding unit 30 in the finish-grinding region R3 as illustrated in FIG. 5. The finish grinding of the other side of the wafer W by the finish-grinding unit 30 is performed in a similar manner as the coarse grinding of the other side of the wafer W by the coarse-grinding unit 20, and therefore its description is omitted.

In this first finish-grinding step, however, the other side of the wafer W, as illustrated in FIG. 5, is subjected to finish grinding by setting the chuck-table rotating shaft 13 and the spindle (grinding-stone rotating shaft) 33 at a first finish-grinding tilt correlation that has taken into consideration sinking of the wafer W associated with compression deformation of the protective member F by a vertical load to be received from the annular grinding stones 35*b* during finish grinding. Specifically, finish grinding is set to be performed by tilting the axial centerline CL1 of the chuck-table rotating shaft 13 over an angle $\alpha 2$ (second predetermined angle) with respect to a vertical axial centerline CL2 of the spindle (grinding-stone rotating shaft) 33 as illustrated in FIG. 5. Conversely, by tilting the axial centerline CL2 of the spindle (grinding-stone rotating shaft) 33 over the angle $\alpha 2$ with respect to the vertical axial centerline CL1 of the chuck-table rotating shaft 13, coarse grinding may also be performed. In other words, finish grinding is performed in this first finish-grinding step by titling the axial centerline CL1 of the chuck table rotating shaft 13 and the axial centerline CL2 of the spindle (grinding-stone rotating shaft) 33 relative to each other over the angle $\alpha 2$. It is to be noted that the tilt angle $\alpha 2$ of the axial centerline CL1 of the chuck-table rotating shaft 13 during finish grinding is set to be smaller than the tilt angle $\alpha 1$ (FIG. 4) of the axial centerline CL1 of the chuck-table rotating shaft 13 during coarse grinding ($\alpha 2 < \alpha 1$).

After the other side of the wafer W has been subjected to finish grinding by the finish-grinding unit 30 in the first finish-grinding step, the finish-grinding unit 30 is moved up in the +Z-axis direction by the lift mechanism 3, so that the annular grinding stones (finish-grinding, annular grinding stones) 35*b* is separated from the upper surface of the wafer W. Then, the turn table 2 illustrated in FIG. 1 is rotated by an angle of 120° in the direction of arrow (counterclockwise) about its vertical axis of rotation. The wafer W, the other side of which has been subjected to finish grinding in the finish-grinding region R3, and the chuck table 10 with the wafer W held thereon are next moved to the wafer loading/unloading region R1. In this wafer loading/unloading region R1, the wafer W is unloaded from the chuck table 10 and transferred into the rinsing unit 60 by the second transfer means 73.

2-3) Optional Rinsing Step:

The first grinding step may preferably include a rinsing step after the first finish-grinding step. In this rinsing step, the wafer W is held under suction on the spinner table 61 with the protective member F directed downward, the spinner table 61 is rotated by a rotary drive mechanism (not illustrated), and rinse water is then ejected downward from the rinse water nozzle 62 toward the wafer W that is rotating responsively to the rotation of the spinner table 61, whereby the upper surface of the wafer W and an upper surface of an outer peripheral portion of the protective member F are rinsed. Although not illustrated in FIG. 1, the rinsing unit 60 includes another rinse water nozzle, and rinse water is ejected from this rinse water nozzle toward a lower surface of the outer peripheral portion of the protective member F for the wafer W to rinse the lower surface of the protective member F.

3) Protective Member Peeling Step:

In the protective member peeling step, the wafer W that has been rinsed preferably as described above is held at the upper surface thereof under suction on a transfer pad, and with the protective member F directed downward, is transferred onto a peeling table. The outer peripheral portion of the protective member F, the outer peripheral portion having been rinsed at the upper surface and lower surface thereof and outwardly protruding from the wafer W, is then gripped by grip portions, and is separated from the wafer W, whereby the protective member F is peeled off from the wafer W. After the protective member F has been peeled off from the wafer W, resin fragments formed by the peeling remain stuck on the wafer W. To remove these resin fragments, the wafer W is rinsed, for example, by bringing a rinsing sponge into contact with the wafer W.

The wafer W, from the one side of which the protective member F has been peeled and removed as mentioned above, is once stored in the cassette 201 by the loading/unloading means 71. By the loading/unloading means 71, the wafer W is then taken out of the cassette 201, is reversed up-side-down, and is transferred onto the alignment table 102. By the first transfer means 72, the wafer W is next transferred onto the chuck table 10 that is waiting in the wafer loading/unloading region R1, is held under suction on the chuck table 10, and is ground on the one side (the surface on the side where the protective member F is formed until the protective member peeling step) thereof in the following second grinding step.

4) Second Grinding Step:

The second grinding step is to grind the one side (on which the protective member F is formed until the protective member peeling step) of the wafer W, the other side of which (where the protective member F is not formed) is subjected to coarse grinding and finish grinding in the first grinding step and from the one side of which the protective member F is peeled off in the protective member peeling step, and includes 4-1) a second coarse-grinding step and 4-2) a second finish-grinding step, both of which will hereinafter be described.

4-1) Second Coarse-Grinding Step:

The second coarse-grinding step is to subject the one side, on which the protective member F is formed until the protective member peeling step, of the wafer W to coarse grinding by the coarse-grinding unit 20 illustrated in FIG. 1. In this second coarse-grinding step, the turn table 2 illustrated in FIG. 1 is rotated by 120°, so that the chuck table 10 with the wafer W transferred thereto by the second transfer means 73 and held under suction thereon is transferred along with the wafer W to the coarse-grinding region R2. In this coarse-grinding region R2, the one side of the wafer W held on the holding surface 10*a* of the chuck table 10 is subjected to coarse grinding by the coarse-grinding unit 20.

Figure 6:
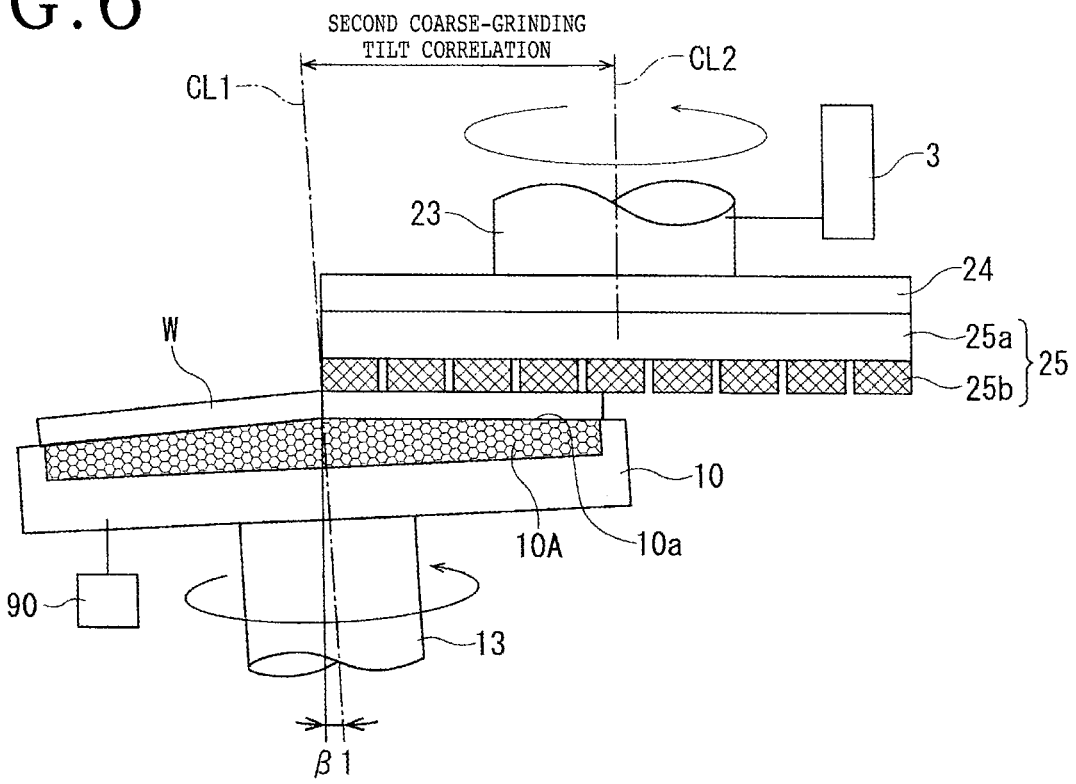
FIG. 6 is a cut-away side view illustrating a second coarse-grinding step in the grinding method.

The finish grinding of the one side of the wafer W in this second coarse-grinding step is performed in a similar manner as the coarse grinding in the first grinding step, and therefore its description is omitted. In this second coarse-grinding step, however, the one side of the wafer W, as illustrated in FIG. 6, is subjected to coarse grinding by setting the chuck-table rotating shaft 13 and the spindle (grinding-stone rotating shaft) 23 at such a second coarse-grinding tilt correlation that the lower surface of the annular grinding stones 25*b*, at which the annular grinding stones 25*b* is to be in contact with the wafer W during grinding, and the holding surface 10*a* of the chuck table 10 become parallel to each other. Specifically, coarse grinding is set to be performed by tilting the axial centerline CL1 of the chuck-table rotating shaft 13 over an angle β1 (third predetermined angle) with respect to the vertical axial centerline CL2 of the spindle (grinding-stone rotating shaft) 23 as illustrated in FIG. 6.

In this embodiment, the coarse grinding is set to be performed by tilting the axial centerline CL1 of the chuck-table rotating shaft 13 over the angle β1 with respect to the axial centerline CL2 of the spindle (grinding-stone rotating shaft) 23. Conversely, by tilting the axial centerline CL2 of the spindle (grinding-stone rotating shaft) 23 over the angle β1 with respect to the vertical axial centerline CL1 of the chuck-table rotating shaft 13, coarse grinding may also be performed. In other words, coarse grinding is performed in this second coarse-grinding step by titling the axial centerline CL1 of the chuck table rotating shaft 13 and the axial centerline CL2 of the spindle (grinding-stone rotating shaft) 23 relative to each other over the angle β1. The thickness of the wafer W that is subjected to coarse grinding in this second coarse-grinding step is measured by the thickness gauge 50.

4-2) Second Finish-Grinding Step:

The second finish-grinding step is to perform, by the finish-grinding unit 30, finish grinding of the one side (the surface on the side where the protective member F is formed until the protective member peeling step) of the wafer W after the wafer W has been subjected at the one side thereof to coarse grinding in the second coarse-grinding step.

Figure 7:
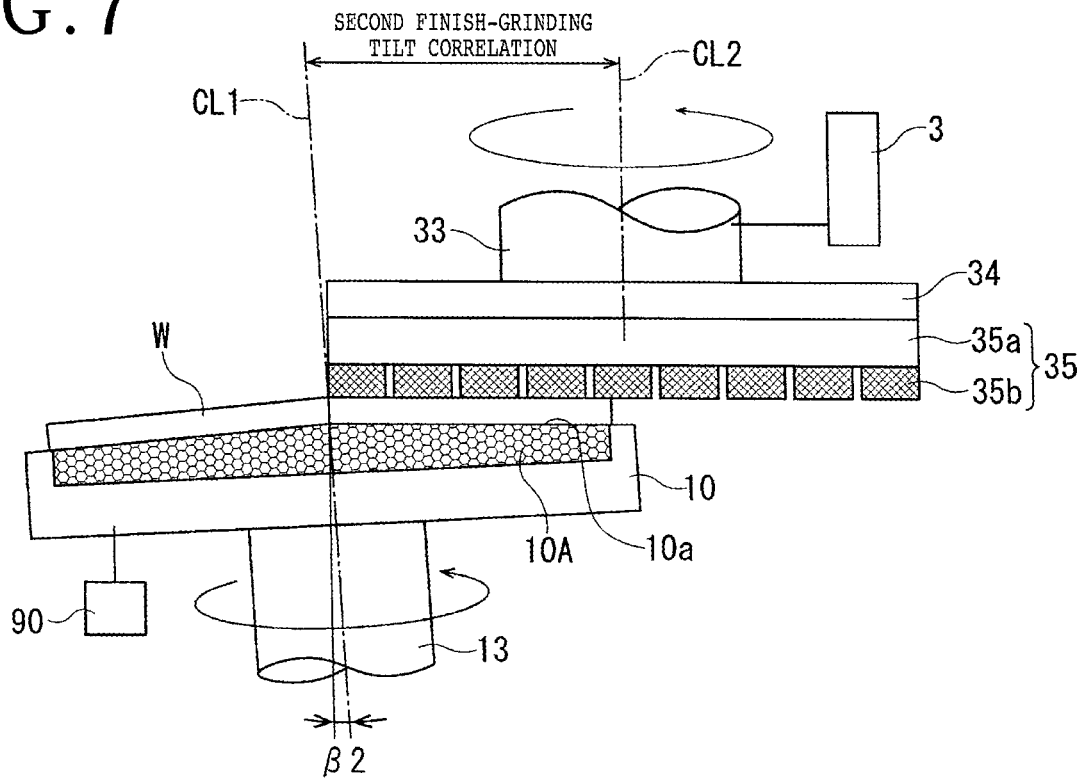
FIG. 7 is a cut-away side view illustrating a second finish-grinding step in the grinding method.

After the one side of the wafer W has been subjected to coarse grinding by the coarse-grinding unit 20 as mentioned above, the coarse-grinding unit 20 is moved up in the +Z-axis direction by the lift mechanism 3, so that the annular grinding stones 25*b* is separated from the other side (upper surface) of the wafer W. Then, the turn table 2 is rotated by an angle of 120° in the direction of arrow (counterclockwise) about its vertical axis of rotation. The wafer W, the one side of which has been subjected to coarse grinding in the coarse-grinding region R2, and the chuck table 10 with the wafer W held thereon are next moved to the finish-grinding region R3. In this finish-grinding region R3, the one side of the wafer W is then subjected to finish grinding by the finish-grinding unit 30 in the finish-grinding region R3 as illustrated in FIG. 7. The finish grinding of the one side of the wafer W by the finish-grinding unit 30 is performed in a similar manner as the coarse grinding of the one side of the wafer W by the coarse-grinding unit 20, that is, the second coarse-grinding step, and therefore its description is omitted. In this second finish-grinding step, however, the one side of the wafer W is set to be subjected to finish grinding by setting the chuck-table rotating shaft 13 and the spindle (grinding-stone rotating shaft) 33 at such a second finish-grinding tilt correlation that the lower surface of the annular grinding stones 35*b*, at which the annular grinding stones 35*b* is to be in contact with the wafer W during grinding, and the holding surface 10*a* of the chuck table 10 become parallel to each other. Specifically, the one side of the wafer W is subjected to finish grinding by tilting the axial centerline CL1 of the chuck-table rotating shaft 13 over an angle β2 (fourth predetermined angle) with respect to the vertical axial centerline CL2 of the spindle (grinding-stone rotating shaft) 33 as illustrated in FIG. 7. Conversely, by tilting the vertical axial centerline CL2 of the spindle (grinding-stone rotating shaft) 33 over the angle β2 with respect to the axial centerline CL1 of the chuck-table rotating shaft 13, finish grinding may also be performed. In other words, finish grinding is performed in this second finish-grinding step by titling the axial centerline CL1 of the chuck table rotating shaft 13 and the axial centerline CL2 of the spindle (grinding-stone rotating shaft) 33 relative to each other over the angle β2. Here, the tilt angle β2 of the axial centerline CL1 of the chuck-table rotating shaft 13 during finish grinding is set to be smaller than the tilt angle β1 (see FIG. 6) of the axial centerline CL1 of the chuck-table rotating shaft 13 during coarse grinding (β2<β1).

After the one side of the wafer W has been subjected to finish grinding by the finish-grinding unit 30 in the second finish-grinding step, the finish-grinding unit 30 is moved up in the +Z-axis direction by the lift mechanism 3, so that the annular grinding stones 35*b* is separated from the upper surface of the wafer W. Then, the turn table 2 illustrated in FIG. 1 is rotated by an angle of 120° in the direction of arrow (counterclockwise) about its vertical axis of rotation. The wafer W, the one side of which has been subjected to finish grinding in the finish-grinding region R3, and the chuck table 10 with the wafer W held thereon are next moved to the wafer loading/unloading region R1. In this wafer loading/unloading region R1, the wafer W is unloaded from the chuck table 10 and transferred into the rinsing unit 60 by the second transfer means 73.

In the rinsing unit 60, the wafer W ground on both sides thereof is held under suction on the spinner table 61, and the spinner table 61 and the wafer W are rotationally driven at a predetermined speed. In this state, rinse water is then ejected from the rinse water nozzle 62 toward the wafer, so that grinding debris stuck on the wafer W is rinsed and removed.

The wafer W rinsed in the rinsing unit 60 is then held by the loading/unloading means 71 and transferred into the cassette 202. When the wafer W ground on both sides thereof is stored in the cassette 202, the series of grinding processing on the wafer W come to an end.

As evident from the above description, the grinding method according to this embodiment for the wafer W includes the first grinding step and the second grinding step. The first grinding step includes the first coarse-grinding step that uses the annular grinding stones (coarse-grinding, annular grinding stones) 25*b* and the first finish-grinding step that uses the annular grinding stones (finish-grinding, annular grinding stones) 35*b*. The second grinding step includes the second coarse-grinding step that uses the annular grinding stones 25*b*, and the second finish-grinding step that uses the annular grinding stones 35*b*. In the first coarse-grinding step, the chuck-table rotating shaft 13 and the spindle (grinding-stone rotating shaft) 23 are set at the first coarse-grinding tilt correlation that has taken into consideration sinking of the wafer W associated with compression deformation of the protective member F by a vertical load to be received from the annular grinding stones 25*b* during coarse grinding. In the first finish-grinding step, the chuck-table rotating shaft 13 and the spindle (grinding-stone rotating shaft) 33 are set at the first finish-grinding tilt correlation that has taken into consideration sinking of the wafer W associated with compression deformation of the protective member F by a vertical load to be received from the annular grinding stones 35*b* during finish grinding. In the second coarse-grinding step, the chuck-table rotating shaft 13 and the spindle (grinding-stone rotating shaft) 23 are set at the second coarse-grinding tilt correlation such that the lower surface of the annular grinding stones 25*b*, at which the annular grinding stones 25*b* is to be in contact with the wafer W during coarse grinding, and the holding surface 10*a* of the chuck table 10 become parallel to each other. In the second finish-grinding step, the chuck-table rotating shaft 13 and the spindle (grinding-stone rotating shaft) 33 are set at the second finish-grinding tilt correlation such that the lower surface of the annular grinding stones 35*b*, at which the annular grinding stones 35*b* is to be in contact with the wafer W during finish grinding, and the holding surface 10*a* of the chuck table 10 become parallel to each other. Owing to the setting at these tilt correlations, an advantageous effect can be obtained that the wafer W can be ground to a uniform thickness over the entire surface thereof without being affected by the sinking of the wafer W associated with compression deformation of the protective member F.

The description has been made above about the embodiment in which the method of the present invention is applied to the grinding method for the slice wafer as performed on the grinding machine including the coarse-grinding unit and the finish-grinding unit. However, the present invention can also be similarly applied to a method for grinding a slice wafer by a grinding machine including a single grinding unit that has annular grinding stones. In this case, the grinding method includes a first grinding step to be performed by the single grinding unit, and a second grinding step to be performed by the same single grinding stone. In the first grinding step, a chuck-table driving shaft and a spindle (grinding-stone rotating shaft) are set at a first tilt correlation that has taken into consideration sinking of the wafer associated with compression deformation of a protective member by a vertical load to be received from the annular grinding stones during grinding. In the second grinding step, on the other hand, the chuck-table rotating shaft and the spindle (grinding-stone rotating shaft) are set at a second tilt correlation such that a lower surface of the annular grinding stones, at which the annular grinding stones are to be in contact with the wafer during grinding, and the holding surface of the chuck table become parallel to each other. Owing to the setting at these tilt correlations, the above-described advantageous effect can be obtained similarly.

The present invention is not limited to the details of the above-described preferred embodiment. The scope of the invention is defined by the appended claims and all changes and modifications as fall within the equivalence of the scope of the claims are therefore to be embraced by the invention.

What is claimed is:

1. A method for grinding a slice wafer on both sides thereof by annular grinding stones, comprising:

a protective member forming step of forming a protective member by spreading a liquid resin over an entirety of one side of the slice wafer and curing the liquid resin;

a first grinding step of grinding an entirety of an other side of the slice wafer by holding the slice wafer on a conical holding surface of a chuck table via the protective member, setting a chuck-table rotating shaft, which passes through a center of the holding surface, and a grinding-stone rotating shaft, which passes through a center of the annular grinding stones, at a first tilt correlation that has taken into consideration sinking of the slice wafer by compression of the protective member through contact of the annular grinding stones with the slice wafer during grinding, rotating the chuck table with the slice wafer held thereon and the annular grinding stones in a same direction at different speeds, and bringing the rotating annular grinding stones into contact at a lower surface thereof with a radial segment of the other side of the rotating slice wafer;

a protective member peeling step of, after the first grinding step, peeling off the protective member; and a second grinding step of, after the protective member peeling step, grinding the slice wafer on the entirety of the one side thereof to a predetermined thickness by holding the other side of the slice wafer on the holding surface of the chuck table, setting the chuck-table rotating shaft and the grinding-stone rotating shaft at a second tilt correlation such that the lower surface of the annular grinding stones, at which the annular grinding stones are to be in contact with the slice wafer during grinding, and the holding surface of the chuck table become parallel to each other, rotating the chuck table with the slice wafer held thereon and the annular grinding stones in the same direction at different speeds, and bringing the rotating annular grinding stones into contact at the lower surface thereof with a radial segment of the one side of the rotating slice wafer, wherein:

the first grinding step includes a first coarse-grinding step using coarse-grinding, annular grinding stones, and a first finish-grinding step using finish-grinding, annular grinding stones, in the first coarse-grinding step, the chuck-table rotating shaft and a coarse-grinding-stone rotating shaft, which passes through a center of the coarse grinding, annular grinding stones, are set at a first coarse-grinding tilt correlation that has taken into consideration sinking of the slice wafer associated with compression deformation of the protective member by a vertical load to be received from the coarse grinding, annular grinding stones during coarse grinding, the chuck table with the slice wafer held thereon and the coarse grinding, annular grinding stones are rotated in the same direction at different speeds, and the entirety of the other side of the rotating slice wafer is subjected to coarse grinding by the rotating coarse-grinding annular grinding stones, in the first finish-grinding step, the chuck-table rotating shaft and a finish-grinding-stone rotating shaft, which passes through a center of the finish-grinding, annular grinding stones, are set at a first finish-grinding tilt correlation that has taken into consideration sinking of the slice wafer associated with compression deformation of the protective member by a vertical load to be received from the finish-grinding, annular grinding stones during finish grinding, the chuck table with the slice wafer held thereon and the finish-grinding, annular grinding stones are rotated in the same direction at different speeds, and the other side of the rotating slice wafer is subjected to finish grinding by the rotating finish-grinding, annular grinding stones, in the first coarse-grinding step, the coarse grinding is performed by tilting an axial centerline of the chuck-table rotating shaft over a first predetermined angle with respect to an axial centerline of the coarse-grinding-stone rotating shaft, and in the first finish-grinding step, the finish grinding is performed by tilting the axial centerline of the chuck-table rotating shaft over a second predetermined angle smaller than the first predetermined angle with respect to an axial centerline of the finish-grinding-stone rotating shaft.

2. The method according to claim 1, wherein the second grinding step includes a second coarse-grinding step using the coarse grinding, annular grinding stones, and a second finish-grinding step using the finish-grinding, annular grinding stones, in the second coarse-grinding step, the chuck-table rotating shaft and the coarse-grinding-stone rotating shaft are set at such a second coarse-grinding tilt correlation that a lower surface of the coarse grinding, annular grinding stones, at which the coarse-grinding, annular grinding stones are to be in contact with the slice wafer during coarse grinding, and the holding surface of the chuck table become parallel to each other, the chuck table with the slice wafer held thereon and the coarse-grinding, annular grinding stones are rotated in the same direction at different speeds, and the entirety of the one side of the rotating slice wafer is subjected to coarse grinding by the rotating coarse-grinding, annular grinding stones, and in the second finish-grinding step, which occurs after the second course-grinding step, the chuck-table rotating shaft and the finish-grinding-stone rotating shaft are set at such a second finish-grinding tilt correlation that a lower surface of the finish-grinding, annular grinding stones, at which the finish-grinding, annular grinding stones are to be in contact with the slice wafer during finish grinding, and the holding surface of the chuck table become parallel to each other, the chuck table with the slice wafer held thereon and the coarse-grinding, annular grinding stones are rotated in the same direction at different speeds, and the one side of the rotating slice wafer is subjected to finish grinding by the rotating finish-grinding, annular grinding stones.

3. The method according to claim 2, wherein, in the second coarse-grinding step, the coarse grinding is performed by tilting the axial centerline of the chuck-table rotating shaft over a third predetermined angle with respect to the axial centerline of the coarse-grinding-stone rotating shaft, and in the second finish-grinding step, the finish grinding is performed by tilting the axial centerline of the chuck-table rotating shaft over a fourth predetermined angle with respect to the axial centerline of the finish-grinding-stone rotating shaft.

* * * * *